US006994349B2

(12) United States Patent
Lambert et al.

(10) Patent No.: US 6,994,349 B2
(45) Date of Patent: Feb. 7, 2006

(54) PORTABLE DUELING TREE

(75) Inventors: Spencer Lambert, Provo, UT (US); Thomas Marshall, Lake Shore, UT (US); Kyle Burdette, Eagle Mountain, UT (US)

(73) Assignee: Action Target, Inc., Provo, UT (US)

( * ) Notice: Subject to any disclaimer, the term of this patent is extended or adjusted under 35 U.S.C. 154(b) by 0 days.

(21) Appl. No.: 10/872,958

(22) Filed: Jun. 21, 2004

(65) Prior Publication Data

US 2005/0001381 A1 Jan. 6, 2005

Related U.S. Application Data

(63) Continuation-in-part of application No. 10/383,218, filed on Mar. 6, 2003.

(60) Provisional application No. 60/362,744, filed on Mar. 8, 2002.

(51) Int. Cl.
*F41J 7/00* (2006.01)

(52) U.S. Cl. ..... 273/406; 273/392

(58) Field of Classification Search ..... 273/390–392, 273/406, 407, 386–389, 368; 84/486; 40/475, 40/500, 533

See application file for complete search history.

(56) References Cited

U.S. PATENT DOCUMENTS

| | | | | | |
|---|---|---|---|---|---|
| 1,207,456 | A * | 12/1916 | Whelan | 40/533 |
| 1,348,283 | A * | 8/1920 | Koehl | 273/368 |
| 2,008,359 | A * | 7/1935 | Lamb | 273/402 |
| 2,179,471 | A * | 11/1939 | Lee | 273/368 |
| 2,372,111 | A * | 3/1945 | Norberg | 273/407 |
| 2,905,469 | A * | 9/1959 | Taylor | 273/380 |
| 4,691,925 | A * | 9/1987 | Scholem | 273/407 |
| 4,739,996 | A * | 4/1988 | Vedder | 273/392 |
| 5,263,721 | A * | 11/1993 | Lowrance | 273/390 |
| 5,352,170 | A * | 10/1994 | Condo et al. | 482/83 |
| 5,765,832 | A * | 6/1998 | Huff | 273/354 |
| 6,398,215 | B1 * | 6/2002 | Carroll | 273/108 |
| 6,478,301 | B1 * | 11/2002 | Witmeyer | 273/391 |
| 6,502,820 | B2 * | 1/2003 | Slifko | 273/391 |
| 6,776,418 | B1 * | 8/2004 | Sovine et al. | 273/407 |

* cited by examiner

*Primary Examiner*—Mark S. Graham
(74) *Attorney, Agent, or Firm*—Bateman IP Law Group

(57) ABSTRACT

A modular target system includes a plurality of targets mounted on a center support so that the targets rotate between opposing sides of the center support. Preferably, the targets rotate about an axis which is between about 5 and 30 degrees less than vertical, and have faces which are disposed at an angle between about 5 and 30 degrees less than vertical.

26 Claims, 8 Drawing Sheets

PORTABLE DUELING TREE

RELATED APPLICATIONS

The present application is a Continuation-In-Part Application of U.S. Non-Provisional application Ser. No. 10/383,218, filed Mar. 6, 2003 which claims the benefit of U.S. Provisional Patent Application No. 60/362,744, filed Mar. 8, 2002.

BACKGROUND OF THE INVENTION

1. Field of the Invention

The present invention relates to a target used in shooting sports. In particular, the present invention relates to a portable target system, commonly referred to as a dueling tree, in which a plurality of targets are available to a pair of shooters wherein the targets move when they are hit by the shooters.

2. State of the Art

The use of targets to enhance one's shooting ability is extremely common place. For hundreds of years, soldiers, police officers, and the like have used targets to improve their ability to shoot accurately in war time and other high pressure situations. A variety of different mechanisms have been used to simulate these situations in which the shooter's blood pressure will rise and affect his or her shooting ability.

One common method for generating adrenaline and blood pressure increases in a shooter is to have a competition. The competition may be as simple as shooting at a plurality of clay pigeons or other targets. While isolated shooting at targets in competition situations provides a moderate increase in adrenaline flow, a much more significant increase is caused by head-to-head competition wherein both shooters are shooting a target at the same time. This is even more so if the competition is structured such that both shooters know how well the other shooter is doing.

One system for significantly increasing pressure on the shooter during the competition is the use of a system called a dueling tree. Typically, a dueling tree includes a plurality of targets which are mounted on a central support. The targets are mounted such that if a target is hit by one shooter, the target moves into the firing line of the other shooter. Thus, a shooter attempts to strike the targets and move them into his competitors line of fire as quickly as possible. The first person to have all the targets disposed in their line of fire loses the competition.

While a shooter may concentrate on hitting a particular target to move into his opponents line of fire, that concentration is readily broken when a target from the opponent moves over to his or her line of fire. This scenario quickly develops adrenaline and blood pressure increases and causes the shooter to react similarly to a real live situation in which the shooter's life may be in danger.

One problem with some dueling trees is that a target may not completely move to the other side if hit. Other dueling trees are constructed so that even a grazing of the target will cause it to move. While attempts have been made to correct these problems, considerable improvements could be made.

SUMMARY OF THE INVENTION

In accordance with one aspect of the present invention, the dueling tree includes a plurality of targets which are pivotably mounted to the center support so that when they are struck by a bullet, the target rotates 180 degrees and is disposed on the opposite side of the center support. The dueling tree is configured so that the target will generally not get stuck between either side.

In accordance with another aspect of the present invention, the center support is disposed at an angle. This angle, preferably between 5 and 30 degrees short of vertical, and most preferably about 15 degrees, promotes the target to move forward towards the shooter and prevents the target from rotating to the other side of the central support unless it is solidly hit with a round.

In accordance with another aspect of the present invention, the targets are also disposed at an angle short of vertical. The forward angle causes the target to channel bullets downwardly when impacted, thereby minimizing the risk of back splatter.

In accordance with still yet another aspect of the present invention, the center support has a splatter guard attached thereto. The splatter guard limits the movement of bullet fragments traveling toward the center support so as to avoid the fragments from ricocheting and hitting shooters or other individuals in the area.

In accordance with another aspect of the present invention, the target is configured so that the target has a pin integrally formed therein which forms part of a hinge which enables the target to move between a first position and a second position. Because the pin is formed integrally with the target, it is less susceptible to breaking due to the vibrations of the target caused by the target being hit by bullets. This is in contrast to conventional structures wherein the hinge is welded or otherwise attached to the target. Such configurations often break under the repeated fatigue of the target being hit by a bullet. Furthermore, forming the pin and target from a single piece of material decreases expense, as less handling of the target is required.

In a preferred embodiment of the invention, the target is configured to move between a first position and a second position in such a manner than the target is biased into the first position or the second position, and away from a position therebetween, by gravity. Preferably, this is accomplished by the movement having a vertical component. Thus, the target must move upwardly and then back down as it moves from the first position to the second position and vice versa. This inhibits the target from stopping between the first position and the second position, and thereby encourages the target to be disposed in the line of fire of one of the shooters.

In accordance with another aspect of the present invention, the dueling tree may be constructed in a modular form. The dueling tree may be designed with support feet and shooting target mounting brackets such that the feet and brackets bolt onto a central stand with conventional nuts and bolt. Carriage bolts may be used advantageously in that the rounded head of the carriage bolt may be placed on the outside of the stand where the bolt head may be possibly exposed to stray bullets, such configuration placing the nut on the inside of the stand where it is protected from stray bullets. This is advantageous in that the rounded head of the carriage is less susceptible to damage than an angular nut or bolt head, and it is not required to place a tool on the head of a carriage bolt for disassembly.

A modular dueling tree is advantageous because a person may easily transport the dueling tree to a shooting range or other desired shooting location. A conventional dueling tree which is not modular is typically welded. The dueling tree is thus a large and heavy object which would be difficult to transport. It is also difficult to sell a non-modular dueling tree in a sporting goods store or other conventional sales outlet because the dueling tree must be pre-assembled and thus will be too large and heavy for many stores to accommodate and for many customers to transport. Thus, it is desirable to provide a modular dueling tree to facilitate use by sportsmen and the like.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims. Furthermore, it should be understood that all embodiments of the invention may not achieve all of aspects of the invention and the claims should not be limited by the preferred embodiments.

Figure 1:
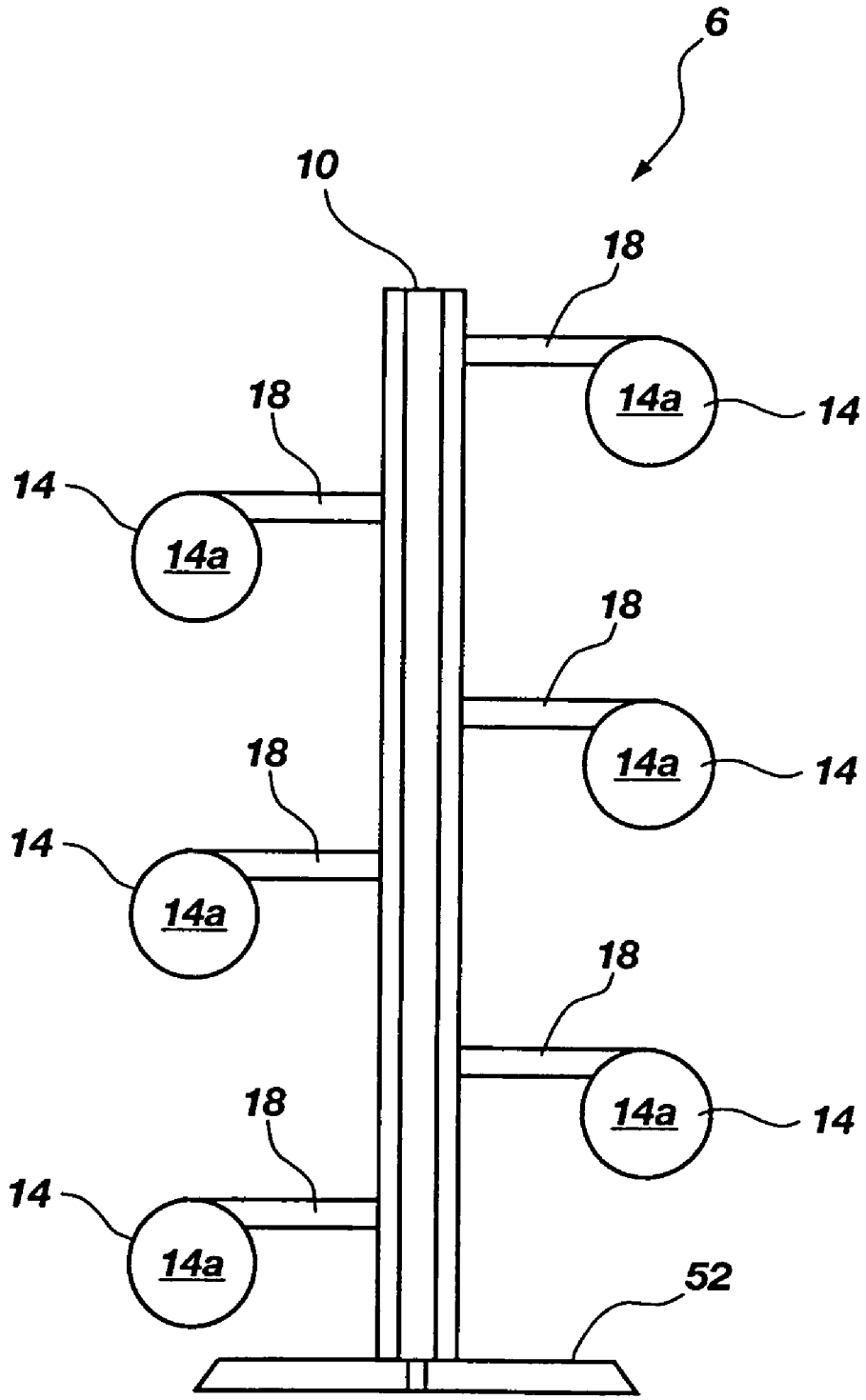
FIG. 1 shows a front view of a dueling tree formed in accordance with the principles of the present invention.

Referring now to FIG. 1, there is shown a front view of a dueling tree, generally indicated at 6, formed in accordance with the principles of the present invention. The dueling tree 6 includes a center support 10, and a plurality of targets 14, which are pivotably mounted to the center support. Each of the targets 14 is mounted such that when the target is hit solidly with a round, the target will rotate approximately 180 degrees and be disposed on the opposing side of the center support 10. As will be explained in additional detail, this can be accomplished by providing a target which has an arm 18 with a portion of the arm forming a pin (not shown). The pin nests in the center support 10 so as to enable the target to rotate about the pin.

During a shooting competition, a plurality of targets 14 are disposed on each side of the center support 10. For example, in FIG. 1, three plates are disposed on each side of the center support. When a shooter's bullet forcefully impacts a target 14, the target rotates to the opposing side of the center support 10. The first person to have all of the targets 14 disposed on their side of the center support 10, loses the competition.

Figure 2:
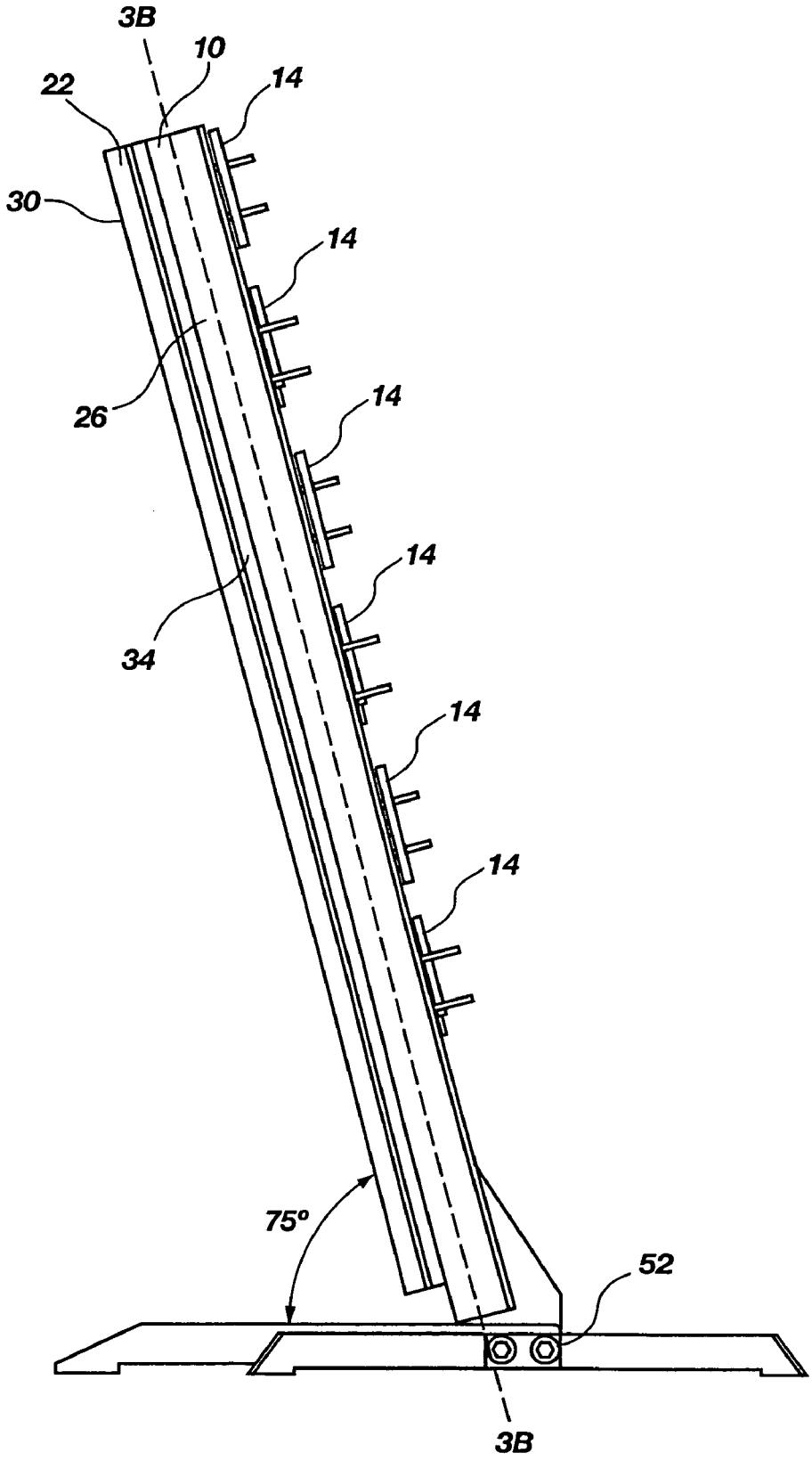
FIG. 2 shows a side view of a dueling tree formed in accordance with the principles of the present invention.

Turning now to FIG. 2, there is shown a side view of the dueling tree 6. The plurality of targets 14 are disposed along the center support 10 so that they are visible only along their ends.

While the center support 10 can be made in variety of configurations, in a preferred embodiment, the center support 10 has a splatter guard 22, which is attached to a deflector plate 26 of the central support 10. The splatter guard 22 receives bullets that splatter laterally toward the center support 10 when impacting the targets 14. Thus, the splatter guard 22 limits the ability of bullet fragments to cross over the central support and injure shooters and by-standers alike. In a preferred embodiment, the splatter guard 22 is formed by a generally V-shaped rail plate 30 which is spaced apart from the deflector plate 26 between 1 to 3 inches. A mid-center rail 34 attaches the plate 30 to the deflector plate 26.

Figure 3:
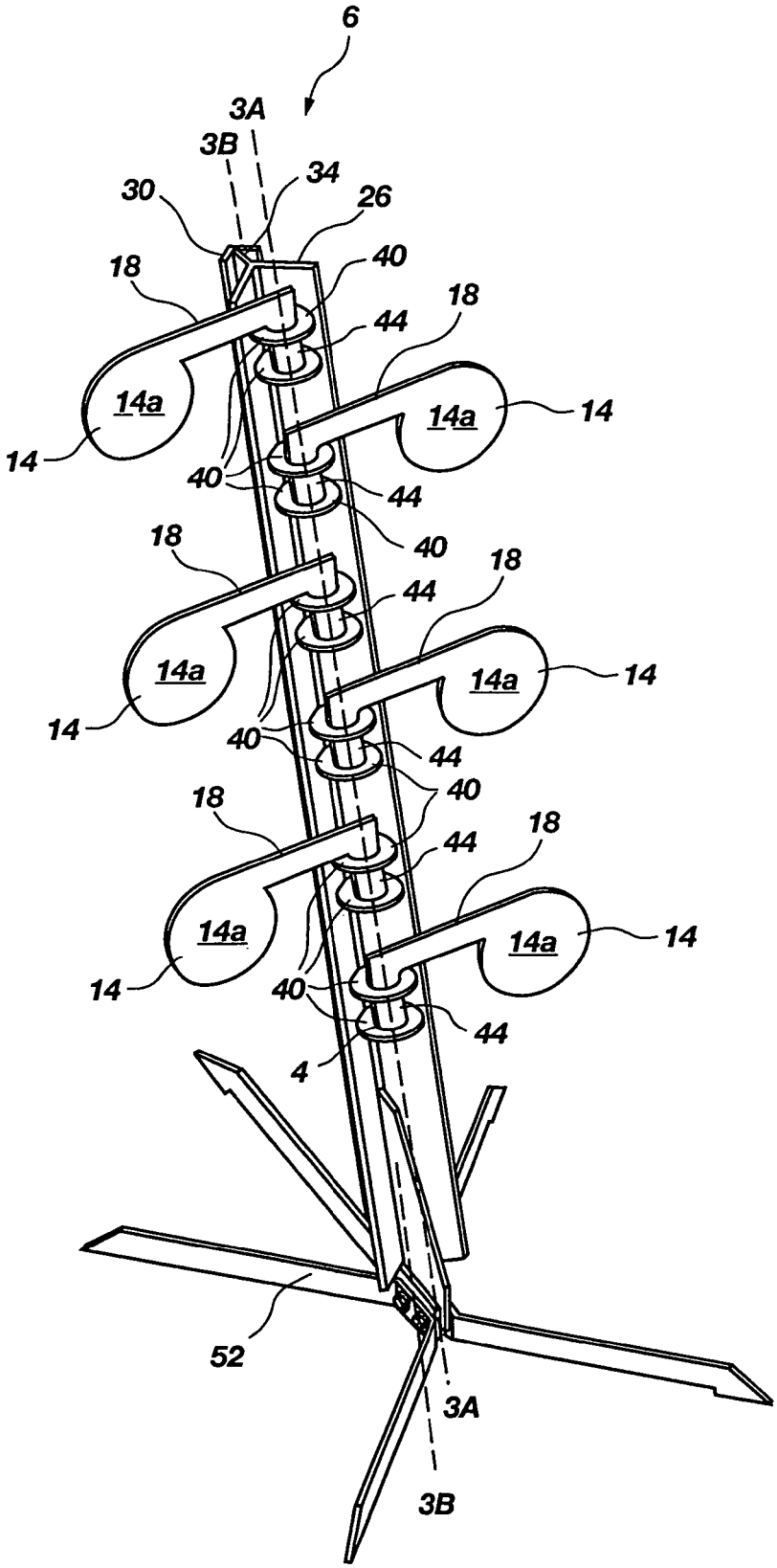
FIG. 3 shows a perspective view of a dueling tree formed in accordance with the principles of the present invention.

Turning now to FIG. 3, there is shown a perspective view of the dueling tree 6. A plurality of rings 40 are attached to the deflector plate 26. The rings are configured to receive a pin 44 formed by a portion of the arm 18 of the target 14. (As shown in FIG. 3, the "pin" need not be cylindrical, and is typically flat. Rather, "pin" is used because the target rotates about an axis 3A—3A extending through the structure).

As a target 14 is struck by a bullet, the target rotates about the pin 44 in rings 40 to the opposing side of the central support 10. It is preferred that the target and the rings 40 are formed from steel to increase longevity of the dueling tree.

As shown in the above-referenced drawings, the dueling tree is preferably disposed in an orientation other than vertical. While the base 52 is disposed horizontally, the longitudinal axis 3B—3B of the central support 10 is disposed at an angle. The angle should be between about 10 and 30 degrees and preferably approximately 15 degrees from vertical (75 degrees from horizontal). This angle provides several advantages. First, the angle encourages the targets 14 to fall into forwardly into a position in which they extend outwardly from the central portion generally perpendicular to the line of fire. If the dueling tree 6 is disposed vertically, the targets have a tendency to bounce backward away from the line of fire and to be disposed where they are not fully presented to the shooter. In the configuration shown in FIG. 3, however, the targets 14 travel along a path in which they move vertically upward as they move horizontally between the first position and a second position disposed on an opposite side of the center support. Thus, the targets are drawn by gravity into either the first position or the second position and away from the area in-between.

Providing the face 14*a* of the target 14 at the same angle, also helps to channel bullet fragments downwardly once they impact the target. This minimizes lateral scattering of the bullet fragments and decreases the risk that a ricochet may injure a shooter or by-stander.

Figure 4:
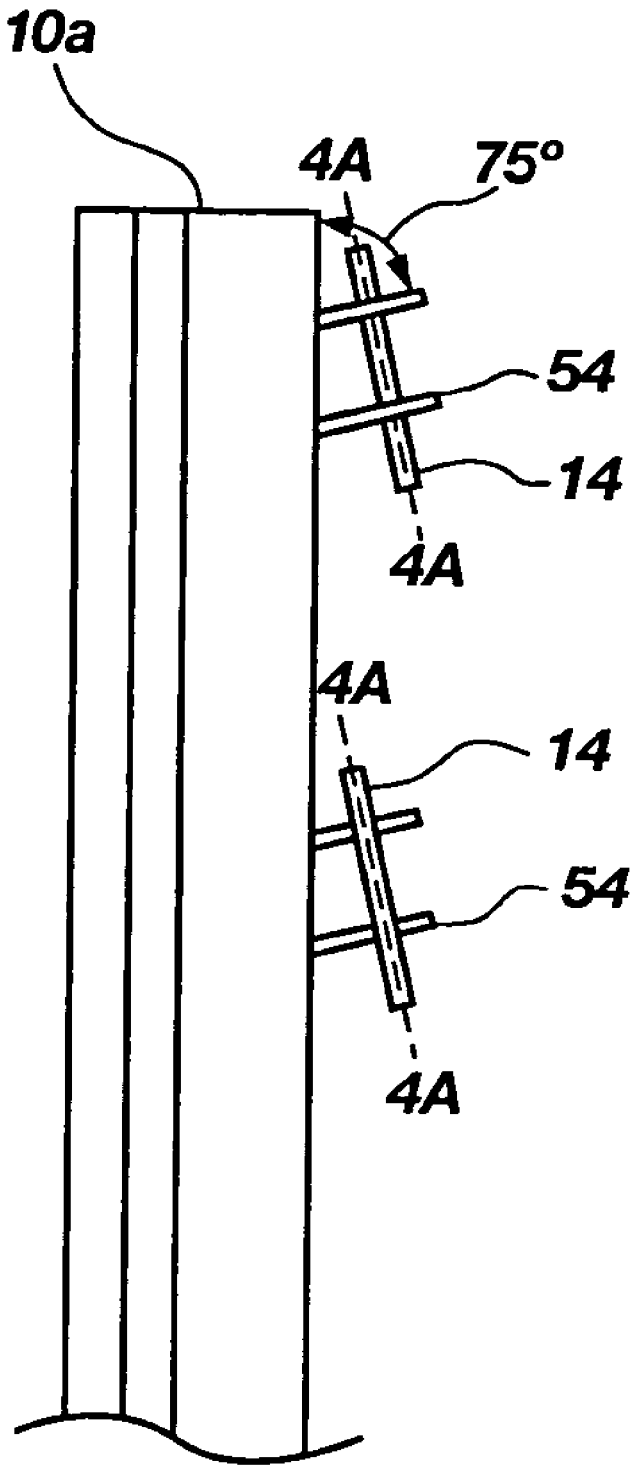
FIG. 4 shows an alternate embodiment of a dueling tree formed in accordance with the principles of the present invention.

Turning now to FIG. 4, there is shown an alternate embodiment of the invention. Rather than having the longitudinal axis of the central support 10*a* at an angle, the central support extends substantially vertically. The rings 54 which hold the targets 14, however, are not disposed perpendicular to the central support 10*a* as in the previous embodiment. Rather, the rings 54 are positioned to extend about between about 10 and 30 degrees above horizontal, or 60 to 80 degrees less than vertical. Preferably, the rings 45 are positioned at about 15 degrees above horizontal. This causes the pins of the targets to rotate about an axis 4A—4A which is 15 degrees less than of vertical (i.e. 75 degrees above horizontal). As with the prior embodiment, the angle tends to cause the targets to rotate forwardly into a position perpendicular to the line of fire. This also results in the face of the targets 14 being angled downwardly about 15 degrees, thereby deflecting bullets downwardly.

Turning now to FIGS. 5–8, a modular dueling tree is shown. The modular dueling tree shown is constructed of flat plate steel, and is designed such that no welding is required in construction of the modular dueling tree. In addition, minimal bending is required to form the pieces of the modular dueling tree. This is advantageous in that the modular dueling tree is significantly easier and less costly to construct. Complex bending or shaping and welding adds significantly to the time and expense of producing a dueling tree.

The design of the modular dueling tree shown in FIGS. 5–8 is also advantageous in that a target design that utilizes minimal welding or bending will be stronger than an equivalent design which does use welds and bends. Bending and welding metal can weaken the metal and provide a location where stress accumulates and where premature failure is more likely. Because the modular dueling tree shown is constructed without welds and with minimal bends, it is more durable and will last longer as compared to a design with more welds and bends.

The modular dueling tree is also easier for an individual to transport to a shooting field or other shooting location. A dueling tree which is welded together or otherwise constructed in a non-modular form can not be disassembled for transport and will typically be quite large. In contrast, the modular dueling tree shown may be quickly disassembled for transportation to and from a shooting location. Additionally, the modular dueling tree may be sold disassembled and the purchaser may assemble the modular dueling tree as desired. Assembly is a simple and quick process as there are a minimal pieces to assemble, and the pieces are assembled with nut and bolts.

Figure 5:
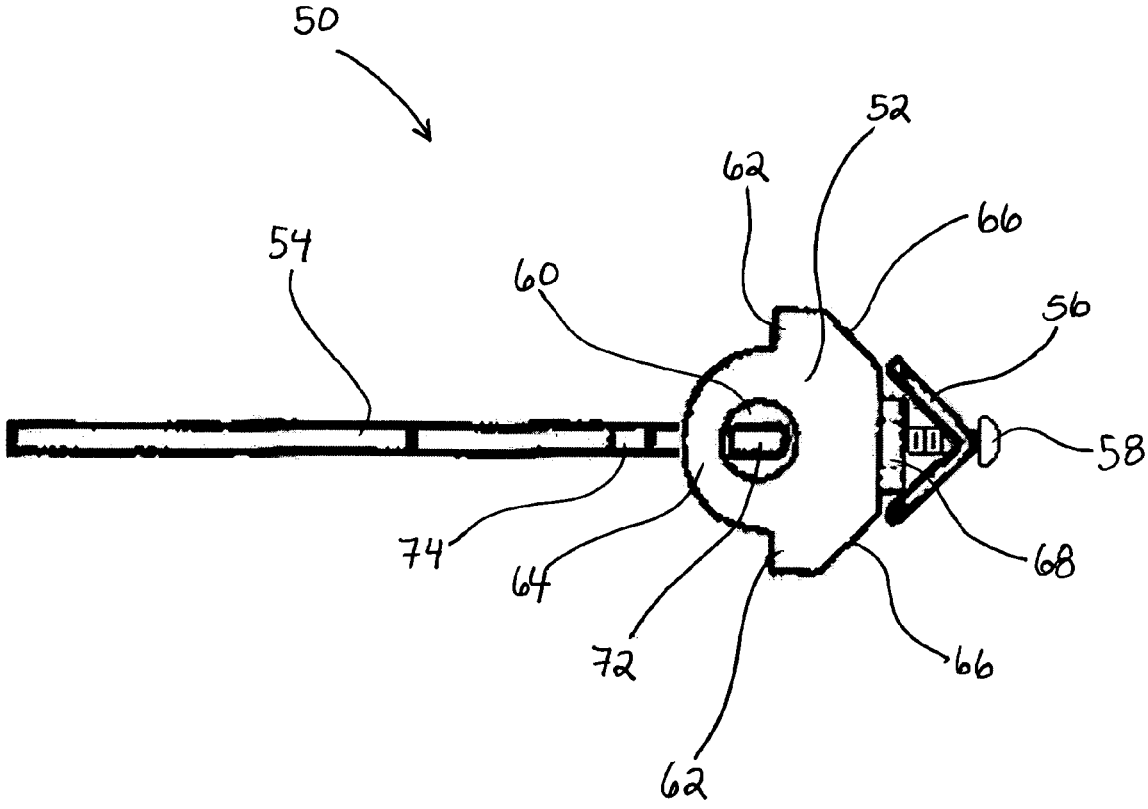
FIG. 5 shows a top view of the shooting plate assembly of a modular dueling tree in accordance with the principles of the present invention.

Turning now to FIG. 5, a top view of the shooting plate assembly, indicated generally at 50, of a modular dueling tree made in accordance with the present invention is shown. Visible are the top bracket 52, the shooting plate 54, the support 56, and a bolt 58. The top bracket 52 and a bottom bracket (not shown) are nested together and attached to the support 56 with the bolt 58. Advantageously, the bolt 58 may be selected to be a carriage bolt, which has a rounded head instead of the common hex shaped bolt head. The bolt 58 may then be mounted such that the rounded head portion of the bolt 58 faces the front of the target. This is advantageous is that the rounded head portion of a carriage bolt does not accept a tool for attaching or removing the bolt, and as the bolt may be struck with stray bullets, the bolt may still be easily removed for disassembly or replacement because the nut (not shown), which accepts a tool for assembly and disassembly, is protected from bullets by the support 56. The top bracket 52 has a hole 60 formed therein for receiving a protrusion or pin 72 formed on the shooting plate 54. The hole 60 and pin 72, together with a corresponding hole and protrusion in connection with the bottom bracket form a hinge which allows the shooting plate 54 to pivot.

The top bracket 52 also has a pair of stops 62 against which a stop protrusion 74 on the shooting plate 54 contacts to prevent further rotation of the shooting plate 54. The shooting plate 54 is thus free to rotate approximately 180 degrees between the two stops 62. In operation, the shooting plate 54 is biased by gravity to pivot towards one of the two stops 62 and not remain in a middle position, and will rest against the stop 62 until struck by a bullet. Striking the shooting plate 54 with a bullet will cause the shooting plate to rotate around and come to rest against the other stop 62.

The top bracket 52 also has a rounded front portion 64 which is formed so as to not interfere with the rotation of the shooting plate 54. The front side edges 66 of the shooting plate 52 are typically formed at an angle so as to deflect bullets which may strike the edges 66 away from the shooter. The top bracket 52 is formed with a mounting portion 68 through which the bolt 58 passes to connect the top bracket 52, the bottom bracket, and the support 56 together. Although not shown in FIG. 5, the bottom bracket has a hole, angular front edges, stops, and a rounded front portion similar to that shown on the top bracket 52.

Figure 6:
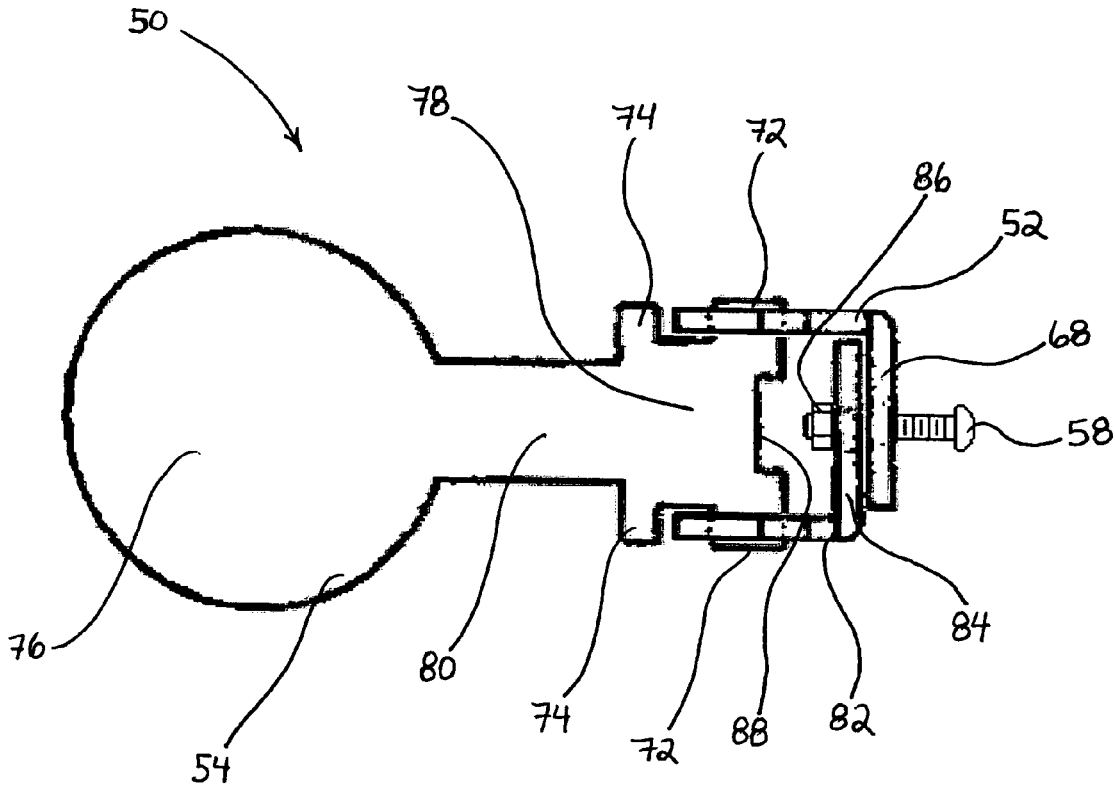
FIG. 6 shows a side view of the shooting plate assembly of FIG. 5 with the support omitted.

Turning now to FIG. 6, a side view of the shooting plate assembly 50 is shown. The side shows the shooting plate 54, which typically has a target area 76, which may be of any desired shape, an attachment area 78, and a neck area 80 which connects the target area 76 to the attachment area 78. Also shown are the pair of pivot protrusions or pins 72, and the pair of stop protrusions 74. The view shows the top bracket 52 and the bottom bracket 82 in relation to each other. As seen, the mounting portion 68 of the top bracket 52 overlaps with the mounting area 84 of the bottom bracket 82. The bolt 58 passes through the mounting areas 68 and 84 and the support (not shown). A nut 86 is used in connection with the bolt 58 to firmly attach the top bracket 52 and bottom bracket 84 to the support. A notch 88 can be formed between the protrusions or pins 72 to facilitate access to the nut 86 with a socket, wrench, or other tool.

Figure 7:
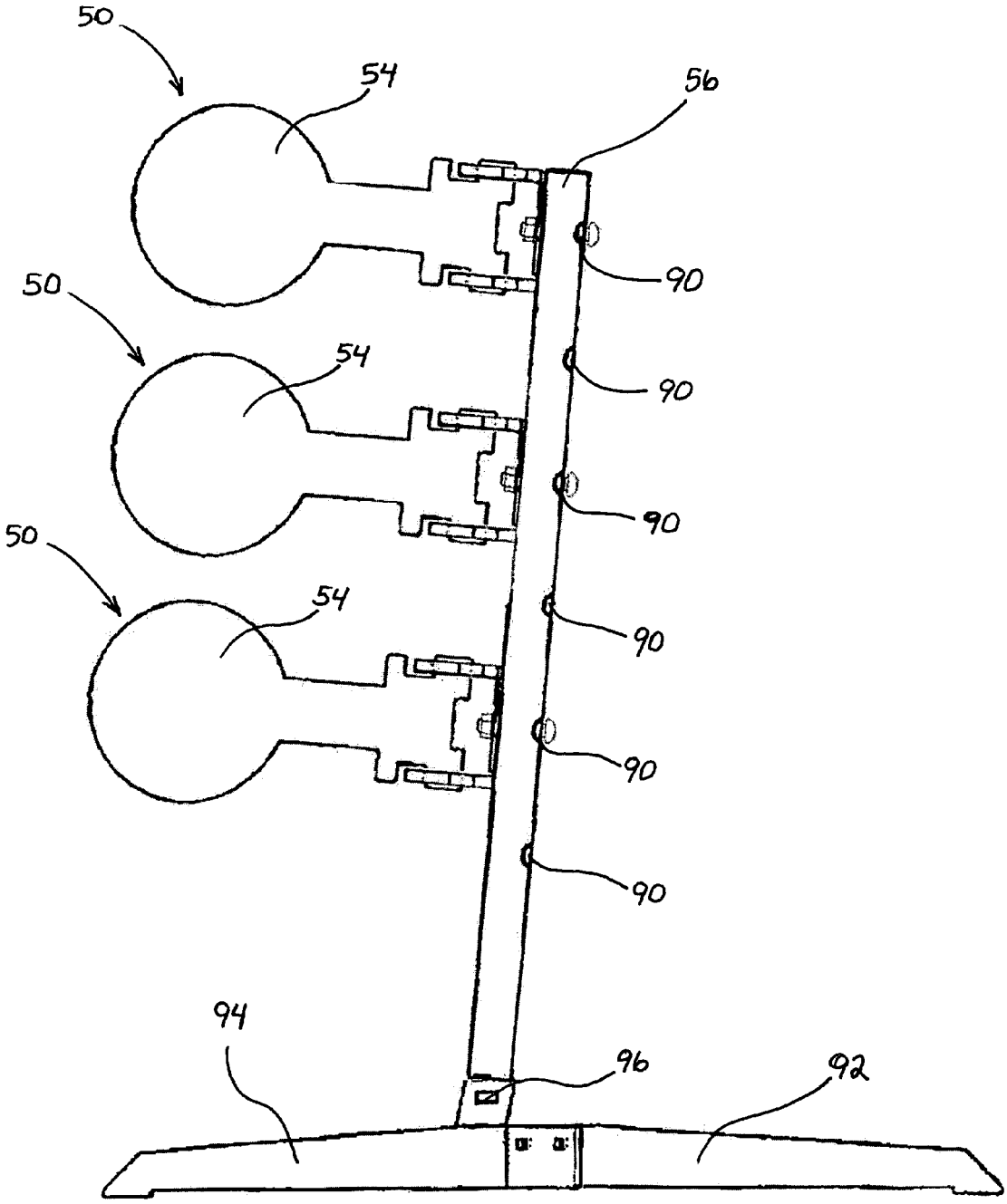
FIG. 7 shows a side view of a modular dueling tree in accordance with the principles of the present invention.

Turning now to FIG. 7, a side view of a modular dueling tree in accordance with the present invention is shown. The modular dueling tree has a number of shooting plate assemblies 50 attached to the support 56. Multiple holes 90 are formed in the support 56 to allow placement of multiple shooting plate assemblies 50 in different locations as desired. The support 56 is attached to a plurality of feet 92 and 94. Typically, a single front foot 92 may be used. The front foot 92 extends directly forwards from the support 56. Two rear feet 94 are typically used, attaching together near the support 56 and extending rearwardly and to the two sides. The rear feet 94 may typically be placed at about a 135 degree angle from the front foot 92, as seen from the top, such that the rear feet will have approximately a 90 degree angle between each other as viewed from the top.

The support 56 attaches to the feet 92 and 94 at an attachment point 96 in the rear feet 94. Typically, the joint 96 may be constructed such that the support 56 locks into a hole in the feet 92 and 94, is bolted to the feet 92 and 94, or both.

It can be seen from FIG. 7 that the support 56 is mounted at a slight angle forwards of vertical. The support 56 is designed to lean slightly forwards in order to bias the shooting plates 54 forwards and to either side of the support 56. This is because the shooting plate 54 rises as it rotates backwards and falls slightly as it rotates forwards. It will be appreciated that although the shooting plates 54 are shown extending directly backwards of the support 56 in FIG. 7, gravity would tend to cause the shooting plates 54 to rotate towards either side of the support 56. Thus, in operation, the shooting plates 54 would be extending sideways from the support 56 until struck by a bullet, which would cause the shooting plates 54 to rotate backwards and continue rotation to the other side of the support 56.

Figure 8:
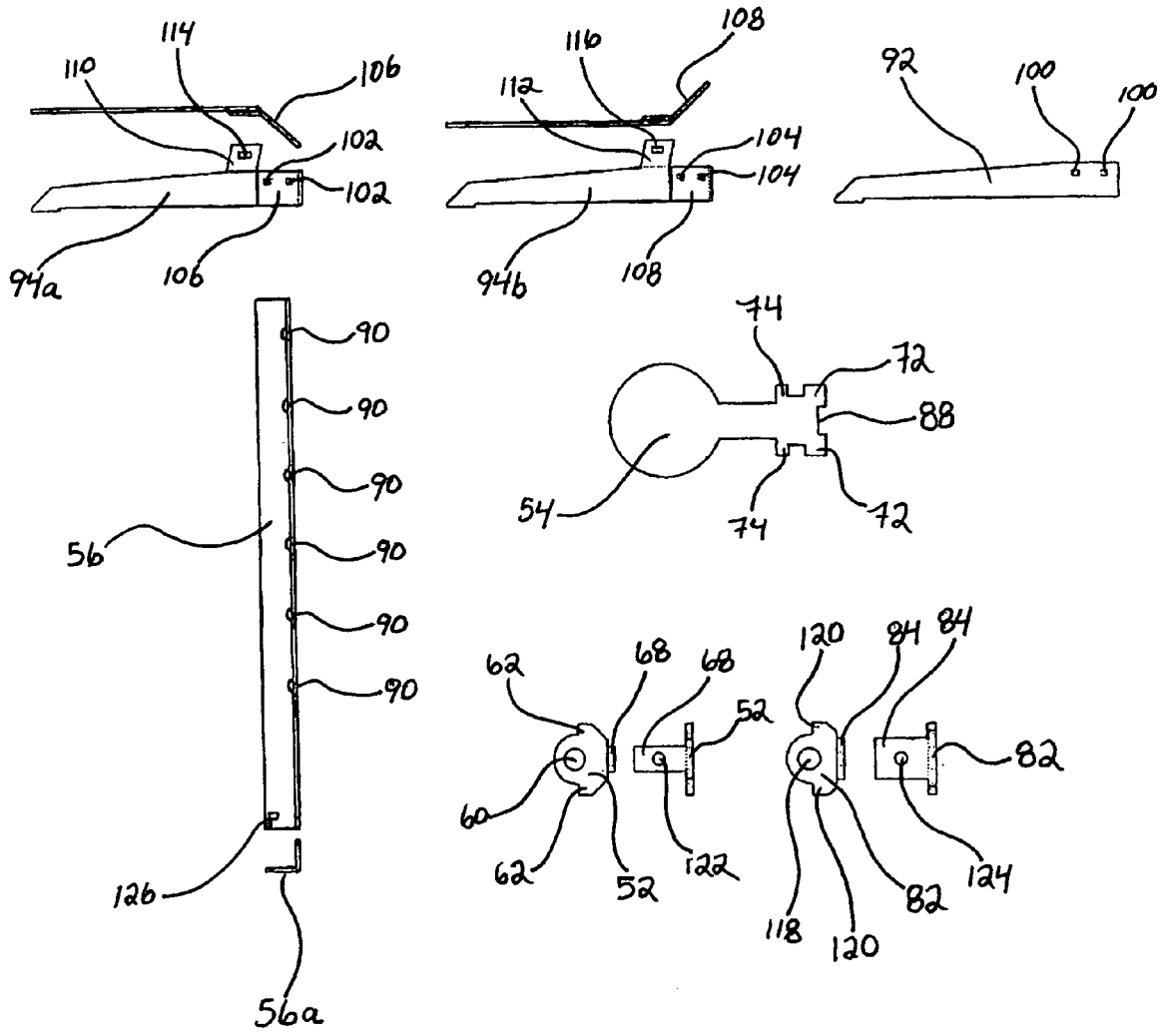
FIG. 8 shows a disassembled view of the individual pieces of a modular dueling tree in accordance with the principles of the present invention.

Turning now to FIG. 8, a disassembled view of the pieces required to construct the modular dueling tree of FIGS. 5–7 is shown. The front foot 92 is shown with two mounting holes 100. The front foot 92 is cut from flat plate steel. The mounting holes 100 allow the front foot 92 to be connected to the rear feet 94*a* and 94*b* via mounting holes 102 and 104.

The rear feet 94*a* and 94*b* have a mounting portion 106 and 108 which is bent sideways such that when the rear feet 94*a* and 94*b* are attached together with the front foot 92, the rear feet 94*a* and 94*b* extend somewhat sideways and not directly backwards from the front foot 92. The rear feet 94*a* and 94*b* also are typically formed with support attachment portions 110 and 112. The support attachment portions 110 and 112 may include holes 114 and 116 for attachment to the support 56.

The shooting plate 54 is shown. The shooting plate 54 is formed from a piece of plate steel, and is optimally formed without bends or welds so as to maximize the strength of the shooting plate 54. Of particular interest are the hinge protrusions 72 and the stop protrusions 74. Also shown is a notch 88 formed between the protrusions or pins 72 which allows for easier mounting and removal of the shooting plate assembly. The hinge protrusions 72 extend into the hole 60 of top bracket 52 and hole 118 of bottom bracket 82 and form a hinge which allows the shooting plate 54 to pivot. The stop protrusions 74 contact the stops 62 of the top bracket 53 and stops 120 of the bottom bracket 82. The top bracket 52 and bottom bracket 82 are formed with mounting holes 122 and 124 formed on a mounting portion 68 and 84, through which a bolt passes to attach the top bracket 52 and bottom bracket 82 to the support 56. The top mounting bracket 52 and bottom mounting bracket 82 are formed from plate steel which is bent into an L shape.

The support 56 is also formed from plate steel, which is bent into an angular channel, as seen from end view 56*a* of the support 56. The support 56 has a number of holes 90 formed therein for attaching individual shooting plate assemblies 50. Although 6 holes 90 are shown, any number of holes 90 may be formed so that a desired number of shooting plate assemblies 50 may be attached to the support 56. The support 56 also has a hole or notch 126 formed in both sides of the channel at one end of the support. The holes or notches 126 formed in the bottom end of the support 56 allow for attachment of the feet 92, 94*a,* and 94*b*. Typically, corresponding holes or notches 114 and 116 are formed in one or more of the feet 92, 94*a,* and 94*b*. Preferably, the two rear feet 94*a* and 94*b* have the holes or notches 114 and 116 formed therein.

As shown in FIGS. 5–8, a modular dueling tree may be formed completely from plate steel with no welding and minimal bending. Such construction is advantageous in that weak spots cause by welds and bends are minimized and the strength of the dueling tree is improved. Additionally, the modular dueling tree may be sold unassembled at any number of retail locations and assembled by the user at the desired location, and easily disassembled for transportation. The modular dueling tree may be quickly and inexpensively produced from a plate steel, and a harder plate may by used as compared to a design requiring more complicated forming processes.

Thus there is disclosed an improved dueling tree and modular dueling tree. While the embodiments shown in FIGS. 1 through 8 are currently preferred embodiments, those skilled in the art will appreciate that numerous modifications can still be made within the principles of the present invention. The appended claims are intended to cover such modifications.

What is claimed is:

1. A modular bullet target system comprising:

a center support configured for extending generally vertically;

a plurality of bullet resistant targets configured for pivotal attachment to the center support in a vertical array so as to enable the targets to pivot between opposing sides of the center support, the targets being mounted to the center support so as to form a hinge which has an axis which is disposed at an angle less than vertical.

2. The target system of claim 1, further comprising a base which is configured for attachment to the center support.

3. The target system of claim 2, wherein the base comprises three feet.

4. The target system of claim 2, wherein the base is formed from plate steel.

5. The target system of claim 1, wherein each of the targets further comprises at least one protrusion configured for pivotal attachment to the center support.

6. The target system of claim 1, wherein the targets are formed from a single piece of flat plate steel.

7. The target system of claim 1, further comprising a plurality of mounting brackets configured for attachment to the center support, and wherein the targets are configured for pivotal attachment to the mounting brackets.

8. The target system of claim 7, wherein each of the targets further comprises at least one protrusion and wherein the mounting brackets further comprise holes for receiving the protrusions thereby forming a hinge.

9. The target system of claim 1, wherein each of the targets further comprises at least one protrusion configured to limit the pivotal movement of the target.

10. A modular bullet target system comprising:

a plurality of bullet targets configured for removable pivotal attachment to a center support and each target configured to pivot between a first position wherein the targets are disposed on a first side of the center support, through a middle position wherein the targets are disposed generally behind the center support, and to a second position wherein the targets are disposed on a second side of the center support when struck by a bullet, and wherein the target pivots about an axis which is disposed at an angle of at least 10 degrees less than vertical relative to a shooter such that the targets are biased towards the first and second positions and away from the middle position; and further comprising a plurality of mounting brackets configured for removable attachment to the center support wherein the targets are configured for pivotal attachment to the mounting brackets, and wherein the each of the targets further comprises at least one protrusion and wherein the mounting brackets further comprise holes for receiving the protrusions thereby forming a hinge.

11. The target system of claim 10, further comprising a center support.

12. The target system of claim 11, wherein the center support is configured for removable attachment to a base.

13. The target system of claim 12, further comprising a base wherein the base comprises at least one foot formed from flat plate steel.

14. The target system of claim 10, wherein each of the targets further comprises at least one protrusion configured to limit the pivotal movement of the target.

15. The target system of claim 10, wherein the targets are formed from a flat piece of plate steel.

16. The target system of claim 10, wherein the targets are biased into either the first position or the second position by gravity.

17. The target system of claim 10, wherein the targets are slanted forwardly.

18. A modular bullet target system comprising:

a center support configured for removable attachment to a base in a generally vertical position;

a plurality of mounting brackets configured for removable attachment to the center support; and a plurality of targets configured for pivotal attachment to the plurality of mounting brackets wherein the targets are pivotal between first and second positions on first and second sides of the center support by moving through an area behind the center support, and wherein the plurality of targets are disposed on a pivotal axis which is less than vertical and less vertical than the generally vertical position such that the targets are biased away from the area behind the center support and towards the first and second positions; and wherein each of the targets further comprises at least one protrusion, and wherein the mounting brackets further comprise holes for receiving the protrusions, thereby forming a hinge.

19. The target system of claim 18, further comprising a base, and wherein the base comprises at least one foot which is formed from plate steel.

20. The target system of claim 19, wherein the targets are formed from a flat piece of plate steel.

21. The target system of claim 18, wherein each of the targets further comprises at least one protrusion configured for limiting the pivotal movement of the target.

22. The target system of claim 21, wherein each of the mounting brackets further comprises at least one surface configured for contacting the protrusions and thereby limiting the pivotal movement of the targets.

23. The target system of claim 18, wherein the pivotal axis of the targets is disposed at an angle of between 10 and 30 degrees less than vertical.

24. A method of forming a modular bullet target system, the method comprising:

selecting a base;

selecting a center support;

selecting at least one target;

removably attaching the at least one target to the center support such that the at least one target is free to pivot from a first side of the center support, behind the center support, and to a second side of the center support;

removably attaching the center support to the base such that the pivotal axis of the at least one target is disposed at an angle which is less than vertical; and wherein the method further comprises selecting at least one mounting bracket, mounting the at least one mounting bracket to the center support, and mounting the at least one target to the at least one mounting bracket, and selecting at least one target wherein each of the at least one target has at least one protrusion and selecting at least one mounting bracket wherein the mounting bracket has a hole for receiving the protrusion and thereby forming a hinge.

25. The method according to claim 24, wherein the method further comprises selecting at least one target wherein each of the at least one target has at least one protrusion configured for forming a pivotal hinge.

26. The method according to claim 24, wherein the method further comprises selecting at least one target wherein each of the at least one target has at least one protrusion configured for limiting the pivotal rotation of the at least one target.

* * * * *